United States Patent [19]

Atkins et al.

[11] Patent Number: 4,570,600

[45] Date of Patent: Feb. 18, 1986

[54] FUEL RAIL ASSEMBLY AND METHOD OF FABRICATION

[75] Inventors: Terrance J. Atkins, Rochester; Martin J. Field, Churchville; Daniel Nolan, Spencerport, all of N.Y.

[73] Assignee: General Motors Corporation, Detroit, Mich.

[21] Appl. No.: 427,763

[22] Filed: Sep. 29, 1982

[51] Int. Cl.[4] ..... F02M 39/00; F02B 3/00

[52] U.S. Cl. ..... 123/468; 251/366; 251/145; 123/456

[58] Field of Search ..... 123/468, 469, 470, 471, 123/472, 457, 459, 460, 461, 462, 463, 464, 465; 251/145, 366; 137/315, 510

[56] References Cited

U.S. PATENT DOCUMENTS

| | | | |
|---|---|---|---|
| 2,628,810 | 2/1953 | Moore | 251/366 |
| 2,677,388 | 5/1954 | Neff | 251/366 |
| 3,511,270 | 5/1970 | Fehrenbach | 123/457 |
| 3,776,209 | 12/1973 | Wertheimer | 123/469 |
| 3,789,819 | 2/1974 | Moulds | 123/468 |
| 3,804,118 | 4/1974 | Love | 251/145 |
| 3,929,109 | 12/1975 | Chamberlain | 123/468 |
| 4,286,563 | 9/1981 | Fahim | 123/456 |

FOREIGN PATENT DOCUMENTS

| | | | |
|---|---|---|---|
| 2816479 | 10/1979 | Fed. Rep. of Germany | 123/468 |
| 7918697 | 8/1980 | Fed. Rep. of Germany | 123/468 |
| 2024933 | 1/1980 | United Kingdom | 123/468 |
| 2024937 | 1/1980 | United Kingdom | 123/468 |

OTHER PUBLICATIONS

DeGarmo, E. Paul, *Materials and Processes in Manufacturing* Collier-Macmillian Limited, London, 1970, pp. 816–821.

*Primary Examiner*—Carl Stuart Miller
*Attorney, Agent, or Firm*—C. K. Veenstra

[57] ABSTRACT

A fuel rail assembly supports injectors for delivering fuel to an engine and includes a pressure regulator to establish the pressure of the fuel supplied to the injectors. The fuel rail body and the pressure regulator base are fabricated from sheet metal, and the pressure regulator base is secured directly to the fuel rail body.

2 Claims, 9 Drawing Figures

FUEL RAIL ASSEMBLY AND METHOD OF FABRICATION

TECHNICAL FIELD

This invention provides an improved fuel rail assembly which supports injectors for delivering fuel to an engine and includes a pressure regulator to establish the pressure of the fuel supplied to the injectors. This invention further provides a novel method of fabricating such a fuel rail assembly.

BACKGROUND

Some fuel injection systems for automotive engines have a plurality of fuel injectors each of which delivers fuel to the inlet port of an associated engine combustion chamber. In some such systems, the fuel injectors are mounted in sockets of a fuel rail which has a passage to supply fuel to the injectors; the fuel rail simplifies installation of the fuel injectors and the fuel supply passage on the engine.

When electromagnetic injectors are employed in such a system, the injectors deliver fuel to the engine in timed pulses and fuel flow is controlled by energizing the injectors at regular intervals and varying the duration of the fuel delivery pulses: when increased fuel delivery is desired, the injectors are energized for longer periods of time to increase the duration of the fuel delivery pulses; when decreased fuel delivery is desired, the injectors are energized for shorter periods of time to decrease the duration of the fuel delivery pulses.

It has been recognized, of course, that variations in the pressure of the fuel supplied to the injectors also affect fuel delivery by the injectors. Accordingly, in order to provide predictable and repeatable fuel delivery by the injectors in response to the duration of the fuel delivery pulses, a fuel pressure regulator is employed to establish the desired fuel supply pressure. The fuel is supplied to the injectors by a pump, and the pump supplies more fuel than is required by the injectors. The excess fuel is directed through a fuel pressure regulator represented, for example, by U.S. Pat. No. 3,511,270. The pressure regulator has a diaphragm which balances the pressure of the fuel supplied to the injectors with the bias of a pressure regulator spring. If the pressure of the fuel supplied to the injectors is less than the spring bias, the diaphragm positions a valve to shut off the excess fuel flow and thus increase the fuel pressure at the injectors; if the pressure of the fuel supplied to the injectors exceeds the spring bias, the diaphragm retracts the valve to discharge the excess fuel and thus reduce the fuel pressure at the injectors.

SUMMARY OF THE INVENTION

This invention provides a compact, lightweight fuel rail assembly in which both the body of the fuel rail and the base of the pressure regulator are fabricated from sheet metal and the pressure regulator base is secured directly to the fuel rail body. This invention further provides a novel method of fabricating such a fuel rail assembly.

In a preferred embodiment of this invention, the fuel rail body is formed with a planar region and an aperture in the planar region. The pressure regulator base is formed with a planar region adapted to overlie the planar region of the fuel rail body, and a tubular fitting is extruded from the planar region of the pressure regulator base into the aperture in the fuel rail body to provide a flow connection from the fuel rail to the pressure regulator. The planar region of the pressure regulator base is then brazed to the planar region of the fuel rail body to maintain the pressure regulator in a securely sealed assembly with the fuel rail body.

The details of the preferred embodiment as well as other features and advantages of this invention are set forth in the remainder of the specification and are shown in the accompanying drawings.

THE PREFERRED EMBODIMENT

Figure 1:
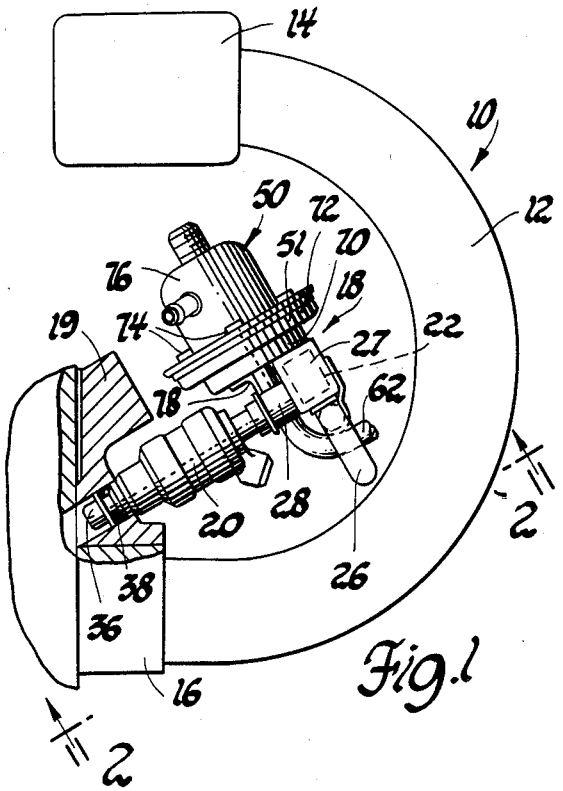
FIG. 1 is an end view of a fuel rail assembly fabricated according to this invention and shown mounted on an engine manifold.
Figure 2:
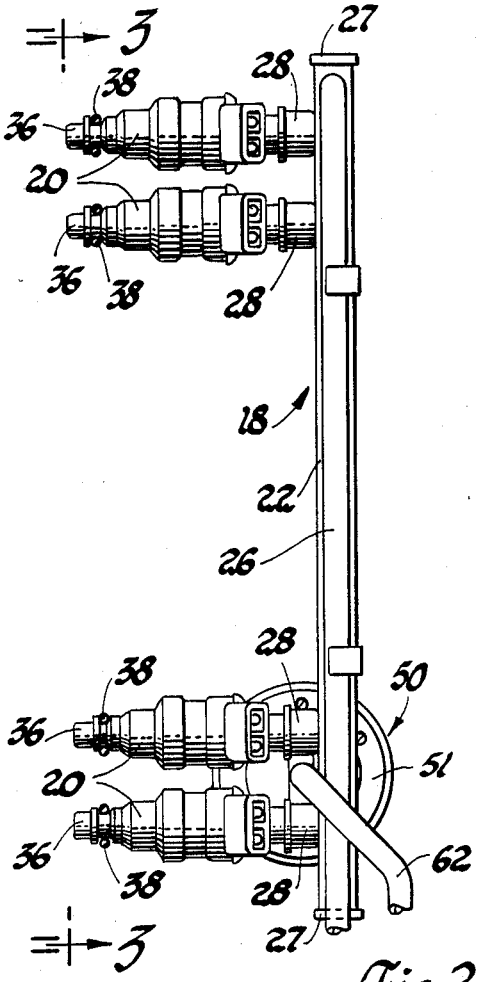
FIG. 2 is an axial view of the fuel rail assembly indicated by the line 2—2 of FIG. 1 but shown removed from the manifold.
Figure 3:
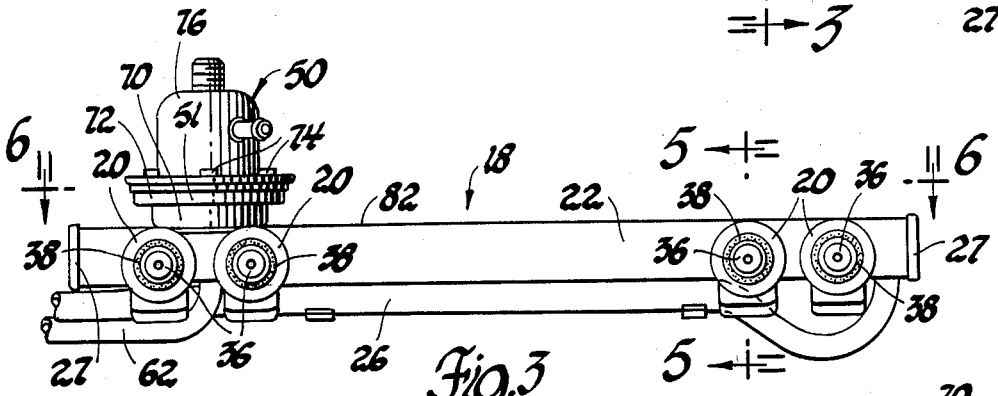
FIG. 3 is an axial view of the fuel rail assembly indicated by the line 3—3 of FIG. 2.
Figure 4:
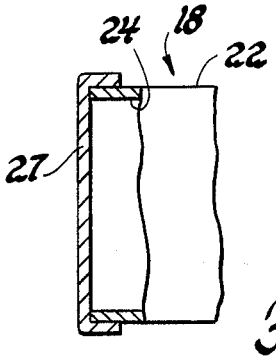
FIG. 4 is an enlarged view of one end of the fuel rail assembly with parts broken away to show a cap closing the end of the fuel rail body.

Referring to the drawings, the inlet manifold 10 of an automotive spark ignition engine has a plurality of ram tubes 12 extending from a plenum 14 to a mounting pad 16 adjacent the inlet ports for the engine combustion chambers (not shown). A fuel rail assembly 18 is secured through a pair of brackets (not shown) on a supplementary mounting pad 19 and has a plurality of injectors 20 each of which delivers fuel through an opening in mounting pad 19 to one of the inlet ports.

Figure 5:
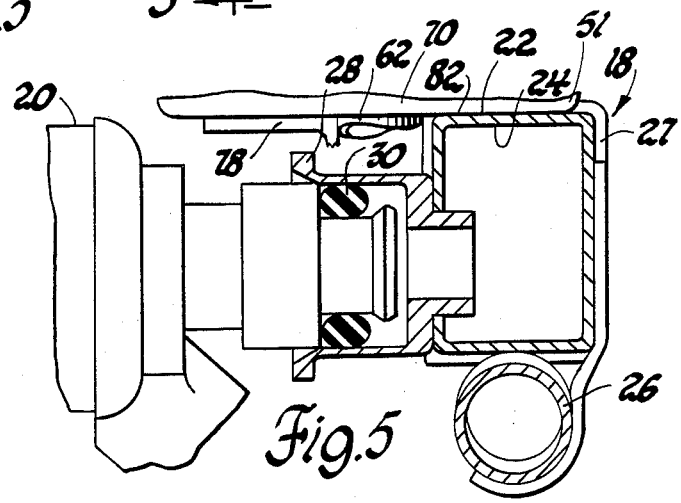
FIG. 5 is a sectional view taken along line 5—5 of FIG. 3 and enlarged to show an injector mounted in an injector socket secured to the fuel rail body.
Figure 6:
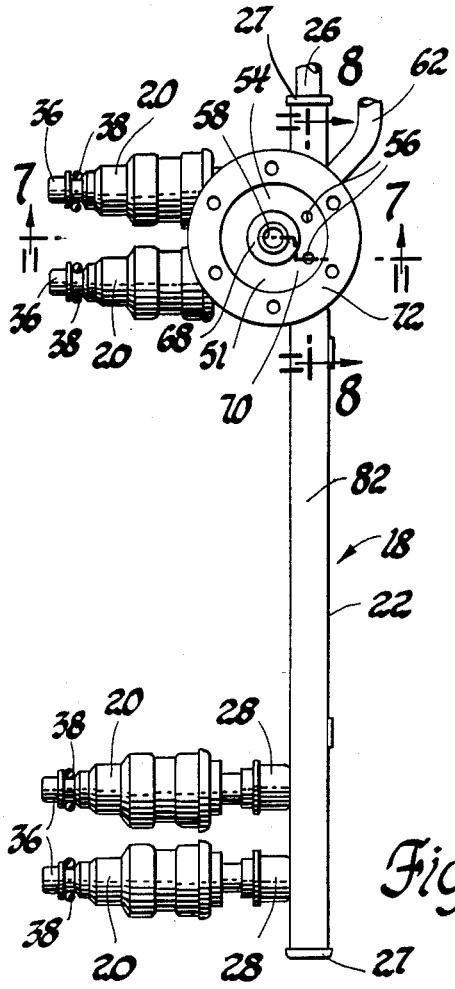
FIG. 6 is an axial view of the fuel rail assembly indicated by the line 6—6 of FIG. 3 with parts of the pressure regulator removed to show the pressure regulator base.

Fuel rail assembly 18 has an elongated sheet metal body 22 forming a fuel supply passage 24 which receives fuel from a fuel supply line 26. Each end of fuel rail body 22 is closed by a plug or cap 27. As shown in FIG. 5, a plurality of injector sockets 28 are secured to fuel rail body 22 and intersect the lower portion of fuel supply passage 24. Each socket 28 receives an injector 20, with an O-ring 30 sealing the injector-socket interconnection. Each injector 20 is retained in its socket 28 by a suitable clip (not shown). The tip 36 of each injector 20 is received in an opening in mounting pad 19 and has an O-ring 38 to seal the injector-mounting pad interconnection.

Figure 7:
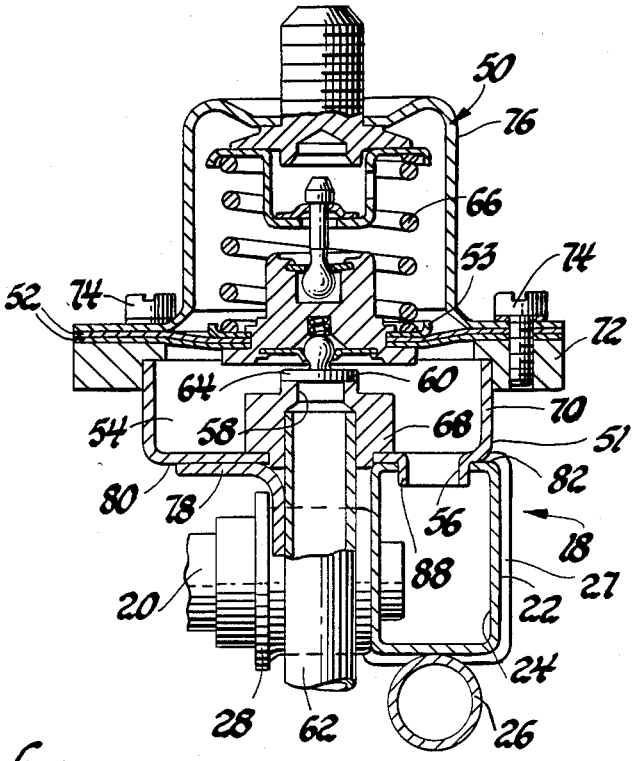
FIG. 7 is a sectional view of the fuel rail assembly taken along line 7—7 of FIG. 6 and enlarged to show the interconnection of the pressure regulator base and the fuel rail body.

As shown in FIG. 7, fuel rail assembly 18 also includes a pressure regulator 50. Pressure regulator 50 has a base 51 and a pair of diaphragms 52 which overlie one another to form a single diaphragm unit and which are clamped to and carry a central diaphragm retainer plate 53. Diaphragms 52 overlie base 51 to define a fuel chamber 54. Base 51 has a fuel access region 56 which opens from fuel supply passage 24 to fuel chamber 54, and a fuel outlet 58 which opens from fuel chamber 54 through a valve seat 60 to a fuel return line 62. Diaphragm retainer plate 53 carries a valve member 64 which cooperates with valve seat 60, and a spring 66 biases diaphragms 52 to engage valve member 64 with valve seat 60. Pressure regulator 50 controls fuel flow past valve seat 60 to balance the fuel pressure in chamber 54 on diaphragms 52 with the bias of spring 66 to thereby maintain a substantially constant fuel pressure in chamber 54 and thus in fuel supply passage 24.

Additional features of the pressure regulator depicted here are fully described and claimed in U.S. Pat. No. 4,436,112 and thus need not be further described here.

The member 68 forming outlet 58 and valve seat 60 is brazed onto fuel return line 62 and is also brazed into a sheet metal cup 70 forming a portion of pressure regulator base 51. Cup 70 is pressed into and brazed to a collar 72 which receives studs 74 employed to clamp diaphragms 52 and a pressure regulator spring housing 76 to base 51. A bracket 78 is brazed to cup 70 and fuel return line 62 to further strengthen the structure.

Figure 8:
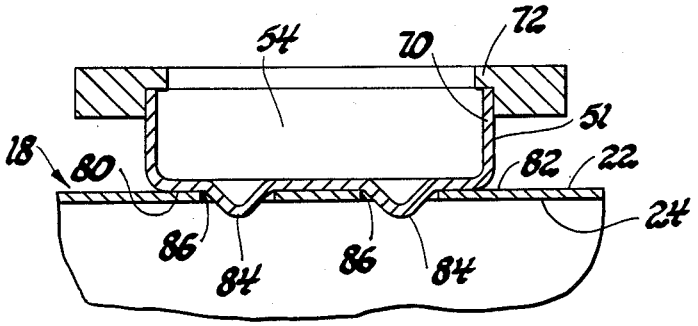
FIG. 8 is an enlarged sectional view, indicated by the line 8—8 of FIG. 6, showing the pressure regulator base and fuel rail body during fabrication of the fuel rail assembly.

Cup 70 is formed with a planar surface 80 which overlies a planar surface 82 formed on fuel rail body 22. Initially, as shown in FIG. 8, the planar surface 80 of cup 70 has a pair of dimples 84 which extend into a pair of apertures 86 in the planar surface 82 of fuel rail body 22; dimples 84 are then extruded into apertures 86 to form the tubular fittings 88 of FIG. 7 which define fuel access regions 56 providing a fuel flow connection opening from fuel supply passage 24 to fuel chamber 54. After extrusion of dimples 84 into apertures 86, cup 70 is brazed to fuel rail body 22 to maintain pressure regulator 50 securely sealed to fuel rail body 22.

Figure 9:
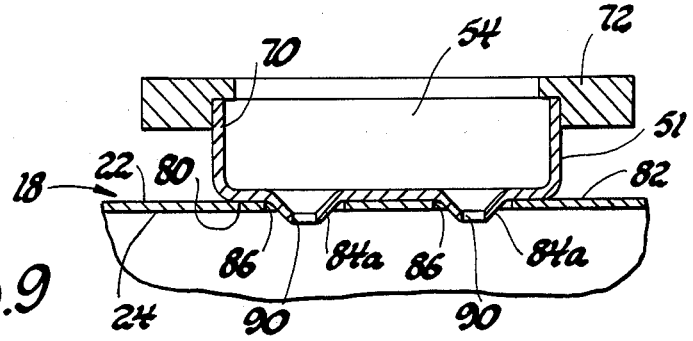
FIG. 9 is a view similar to that of FIG. 8 showing a modified form of the pressure regulator base.

A modified form of the dimples **84*a* is shown in FIG. 9. Dimples 84*a* have a small hole 90 which may be preferred to assist in properly extruding dimples 84*a* into apertures 86**.

The embodiments of the invention in which an exclusive property or privilege is claimed are defined as follows:

1. A fabricated fuel rail assembly for an engine, said assembly comprising an elongated sheet metal fuel rail body defining a fuel supply passage and having a plurality of axially spaced transversely extending fuel injector sockets, said passage intersecting said sockets for supplying fuel to said sockets, each of said sockets receiving a fuel injector adapted to deliver fuel from its socket to the engine, and a fuel pressure regulator for controlling the fuel pressure in said fuel supply passage, said pressure regulator including a diaphragm overlying a sheet metal base and defining a fuel chamber therebetween, said base including a fuel access region opening from said supply passage to said chamber and a fuel outlet opening from said chamber and a valve seat surrounding said outlet, said diaphragm carrying a valve member controlling fuel flow past said valve seat through said outlet, a coil spring engaging said diaphragm and biasing said diaphragm to urge said valve member toward said valve seat whereby fuel flow past said valve seat through said outlet is controlled to balance the fuel pressure on said diaphragm with the bias of said spring on said diaphragm, and wherein said fuel rail body is formed with a planar region and an aperture in said planar region, said pressure regulator base is formed with a planar region which overlies said fuel rail body planar region, said fuel access region is formed as a tubular fitting extruded from said base and extending directly into said aperture to provide a fuel flow connection from said fuel supply passage to said pressure regulator chamber, and said planar region of said pressure regulator base is brazed to said planar region of said fuel rail body to maintain said pressure regulator in a securely sealed assembly with said fuel rail body.

2. The method of fabricating a fuel rail assembly for an engine, said assembly comprising an elongated sheet metal fuel rail body defining a fuel supply passage and having a plurality of axially spaced transversely extending fuel injector sockets, said passage intersecting said sockets for supplying fuel to said sockets, each of said sockets receiving a fuel injector adapted to deliver fuel from its socket to the engine, and a fuel pressure regulator for controlling the fuel pressure in said fuel supply passage, said pressure regulator including a diaphragm overlying a sheet metal base and defining a fuel chamber therebetween, said base including a fuel access region opening from said supply passage to said chamber and a fuel outlet opening from said chamber and a valve seat surrounding said outlet, said diaphragm carrying a valve member controlling fuel flow past said valve seat through said outlet, a coil spring engaging said diaphragm and biasing said diaphragm to urge said valve member toward said valve seat whereby fuel flow past said valve seat through said outlet is controlled to balance the fuel pressure on said diaphragm with the bias of said spring on said diaphragm, said method comprising the steps of forming said fuel rail body with a planar region and an aperture in said planar region, forming said pressure regulator base with a planar region which overlies said fuel rail body planar region, forming said fuel access region by extruding a tubular fitting from said planar region of said pressure regulator base directly into said aperture to provide a fuel flow connection from said fuel supply passage to said pressure regulator chamber, and brazing said planar region of said pressure regulator base to said planar region of said fuel rail body about said fitting and said aperture to securely seal said pressure regulator to said fuel rail body.

* * * * *